US007736076B2

(12) United States Patent
Motoki

(10) Patent No.: US 7,736,076 B2
(45) Date of Patent: Jun. 15, 2010

(54) RIBBON CASSETTE AND PRINTER

(75) Inventor: Zenko Motoki, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 587 days.

(21) Appl. No.: 11/752,171

(22) Filed: May 22, 2007

(65) Prior Publication Data

US 2007/0274757 A1 Nov. 29, 2007

(30) Foreign Application Priority Data

May 23, 2006 (JP) ..... 2006-143152

(51) Int. Cl.
*B41J 35/28* (2006.01)

(52) U.S. Cl. ..... 400/208; 400/207; 400/208.1; 400/248; 101/336; 347/214

(58) Field of Classification Search ..... 400/208, 400/208.1, 207, 248; 101/336; 347/214
See application file for complete search history.

(56) References Cited

U.S. PATENT DOCUMENTS 5,959,652 A * 9/1999 Privin ..... 347/214
6,504,564 B1 * 1/2003 Funaki et al. ..... 347/214
6,650,351 B2 * 11/2003 Yamamoto et al. ..... 347/214
7,522,179 B2 * 4/2009 Lysiak et al. ..... 347/214
7,594,770 B2 * 9/2009 Maruyama et al. ..... 400/208

FOREIGN PATENT DOCUMENTS

JP 2001-205905 7/2001

* cited by examiner

*Primary Examiner*—Ren Yan
*Assistant Examiner*—Matthew G Marini
(74) *Attorney, Agent, or Firm*—Brinks Hofer Gilson & Lione

(57) ABSTRACT

A ribbon cassette and a printer are provided for preventing an ink ribbon from being wound or drawn to a printing-portion paper transport unit of the printer so as to satisfactorily wind and transport the ink ribbon. A convex portion is formed on a wall-portion contact surface of a first connecting member opposed to a space portion, thereby securing a gap between a wall portion of the ribbon cassette and a printing-portion paper transport unit of the printer. A top portion of the convex portion comes in contact with a driven-roller mounting plate disposed in the space portion when a ribbon cassette is mounted in a ribbon cassette mounting portion of a printer.

3 Claims, 7 Drawing Sheets

RIBBON CASSETTE AND PRINTER

CLAIM OF PRIORITY

This application claims the benefit of Japanese Patent Application No. 2006-143152 filed on May 23, 2006, which is hereby incorporated by reference.

BACKGROUND

1. Field of the Invention

The present invention relates to a ribbon cassette, more particularly, to a ribbon cassette and a printer that winds and transports an ink ribbon received in the ribbon cassette in a reliable manner.

2. Description of the Related Art

The known printer (line printer) having a long thermal head in which heat emitting elements are arranged along a width direction of printing paper has been used as a printing apparatus that rapidly performs a printing operation line-by-line or page-by-page on printing paper.

The printer uses a ribbon cassette in which a winding axis and a deliver axis winding the ink ribbon in both sides are separated to be rotatably disposed in the cassette case having a substantially rectangular shape. The ribbon cassette has a cassette case that forms a transport passage of an ink ribbon transported and supplied from a supplying axis to a winding axis between both axes. When the ribbon cassette is mounted, the thermal head of the printer is disposed between both axes. The thermal head is disposed such that the ink ribbon located in the transport passage is interposed therebetween, and the thermal head presses on and comes in contact with a platen so as to be ready to perform the printing operation.

Because a printer shows a tendency to decrease in size, it is necessary to decrease the size of the ribbon cassette mounted in the printer as well.

However, in the ribbon cassette, a space called a pancake receiving the ink ribbon wound between a pair of axes occupies most volume thereof. For this reason, the size of the cassette case increases, whereby it is difficult to reduce the size. Furthermore, it is difficult to reduce the size of the printer that receives the ribbon cassette as the size of the ribbon cassette decreases.

In order to decrease the size of the ribbon cassette, for example, the following ribbon cassette has been developed. The ribbon cassette includes a first receiving portion, a second receiving portion disposed at a predetermined interval from the first receiving portion, a cassette case having first and second connecting members connecting end portions of the first and second receiving portion, and a supplying axis and winding axis that are rotatably received in the supplying axis and the winding axis, respectively.

In the ribbon cassette, a first supporting portion formed of a wall portion that is bridged between the first and second connecting members is provided, and a second supporting portion is provided in the second receiving portion receiving the winding axis so as to correspond to the first supporting portion along the width direction of the ink ribbon. An example of the ribbon cassette is disclosed in JP-A-2001-205905.

In the ribbon cassette, the ink ribbon delivered from the winding axis is bent at the first supporting portion and the second supporting portion, whereby the ink ribbon is wound on the winding axis through the transport passage having a crank shape. When the ribbon cassette is mounted in the printer, the ribbon cassette is formed such that the thermal head of the printer is disposed between the first receiving portion and the wall portion, and a part of the printing-portion paper transport unit faces a space between the second receiving portion, which receives the winding axis and the wall portion. The ribbon cassette has been contrived to have a small size by reducing an unnecessary space in the cassette case. In the printer using this ribbon cassette, because the reduced space of the ribbon cassette can be effectively used, the printer may become small and thin.

In the printing-portion paper transport unit, a paper transport roller (which extends in the width direction of the ink ribbon and is rotatably supported), a driven roller (which extends in the width direction of the ink ribbon and is rotatably supported in contact with the paper transport roller), and a driven-roller mounting plate (which extends in the width direction of the ink ribbon and detachably supports the driven roller to the paper transport roller) are sequentially disposed in a height direction of the wall portion. When printing paper is interposed between the paper transport roller and the driven roller, the transport roller rotates such that the paper is supplied to a printing portion in which the thermal head is disposed or the paper is transported from the printing portion in the backward transporting direction of the transport.

However, the known paper transport roller or the driven roller is generally made of metal substances. Accordingly, while the printing paper is printed in the forward and backward direction respectively, the transported ink ribbon is drawn and wound on the paper transport roller or the driven roller due to static electricity charged to the ink ribbon, whereby the quality of printing image may be deteriorated or the ink ribbon may be cut.

BRIEF SUMMARY

According to a first aspect, a ribbon cassette is provided including a cassette case that has a first receiving portion. A second receiving portion is disposed at a predetermined interval from the first receiving portion and is operable to be inserted into a ribbon cassette mounting portion of a printer together with the first receiving portion. A first connecting member is operable to connect the front ends of the first and second receiving portions in an insertion direction of the first and second receiving portions into the ribbon cassette mounting portion. A second connecting member is operable to connect the rear ends of the first and second receiving portions in the insertion direction of the first and second receiving portions. An ink ribbon is disposed in a supplying axis and a winding axis rotatably received in the first and second receiving portions and is operable to be drawn from the supplying axis and wound on the winding axis. A first supporting portion formed of a wall portion that is bridged between the first and second connecting members is provided. A second supporting portion is provided in the second receiving portion receiving the winding axis so as to correspond to the first supporting portion in a width direction of the ink ribbon. The ink ribbon drawn from the supplying axis and supplied for printing is configured to be bent at the first supporting portion, subsequently bent at the second supporting portion, and wound on the winding axis. A space portion is provided between the wall portion and the second receiving portion such that the space portion faces a part of a printing-portion paper transport unit in which a paper transport roller, which extends in the width direction of the ink ribbon of the printer, is supported so as to rotate. A driven roller, which extends in the width direction of the ink ribbon, is supported so as to rotate in contact with the paper transport roller. A driven-roller mounting plate, which extends in the width direction of the ink ribbon, is supported so as to get close to and apart from the paper transport roller. The paper transport roller, the driven roller, and the driven-roller mounting plate are sequentially disposed along the wall portion. A convex portion is provided on a wall-portion contact surface of the first connecting portion opposed to the space portion so that a top portion of the convex portion comes in contact with the driven-roller mounting plate disposed in the space portion when the ribbon cassette is mounted in the ribbon cassette mounting portion of the printer.

According to a second aspect, in the ribbon cassette, the second supporting portion may be bridged between a side plate portion of the cassette case and a side surface portion of the second receiving portion and may include a shaft rotating about an axis.

According to a third aspect, a printer is provided in which a ribbon cassette is inserted into an insertion port formed in a wall portion of a chassis and is mounted into a cassette mounting portion in the chassis. The ribbon cassette includes a cassette case that has a first receiving portion. A second receiving portion is disposed at a predetermined interval from the first receiving portion and is operable to be inserted into a ribbon cassette mounting portion of a printer together with the first receiving portion. A first connecting member is operable to connect the front ends of the first and second receiving portions in an insertion direction of the first and second receiving portions into the ribbon cassette mounting portion. A second connecting member is operable to connect the rear ends of the first and second receiving portions in the insertion direction of the first and second receiving portions. An ink ribbon is disposed in a supplying axis and a winding axis rotatably received in the first and second receiving portions and is operable to be drawn from the supplying axis and wound on the winding axis. A first supporting portion formed of a wall portion that is bridged between the first and second connecting members is provided. A second supporting portion is provided in the second receiving portion receiving the winding axis so as to correspond to the first supporting portion in a width direction of the ink ribbon. The ink ribbon drawn from the supplying axis and supplied for printing is configured to be bent at the first supporting portion, subsequently bent at the second supporting portion, and wound to the winding axis. A space portion is provided between the wall portion and the second receiving portion such that the space portion faces a part of a printing-portion paper transport unit in which a paper transport roller, which extends in the width direction of the ink ribbon of the printer, is supported so as to rotate. A driven roller, which extends in the width direction of the ink ribbon, is supported so as to rotate in contact with the paper transport roller. A driven-roller mounting plate, which extends in the width direction of the ink ribbon, is supported so as to get close to and apart from the paper transport roller. The paper transport roller, the driven roller, and the driven-roller mounting plate are sequentially disposed along the wall portion. A convex portion opposed to the space portion of the driven-roller mounting plate is provided in a surface opposed to the second connecting portion of the ribbon cassette so that a top portion of the convex portion comes in contact with the first connecting member of the ribbon cassette.

Other systems, methods, features, and advantages of the invention will be, or will become, apparent to one with skill in the art upon examination of the following figures and detailed description. It is intended that all such additional systems, methods, features, and advantages be included within this description.

BRIEF DESCRIPTION OF THE DRAWINGS

The components in the figures are not necessarily to scale, emphasis instead being placed upon illustrating the principles of the invention. Moreover, in the figures, like referenced numerals designate corresponding parts throughout the different views.

DESCRIPTION OF THE PREFERRED EMBODIMENT

Hereinafter, an exemplary embodiment of a ribbon cassette and an exemplary embodiment of a printer will be described.

Figure 1:
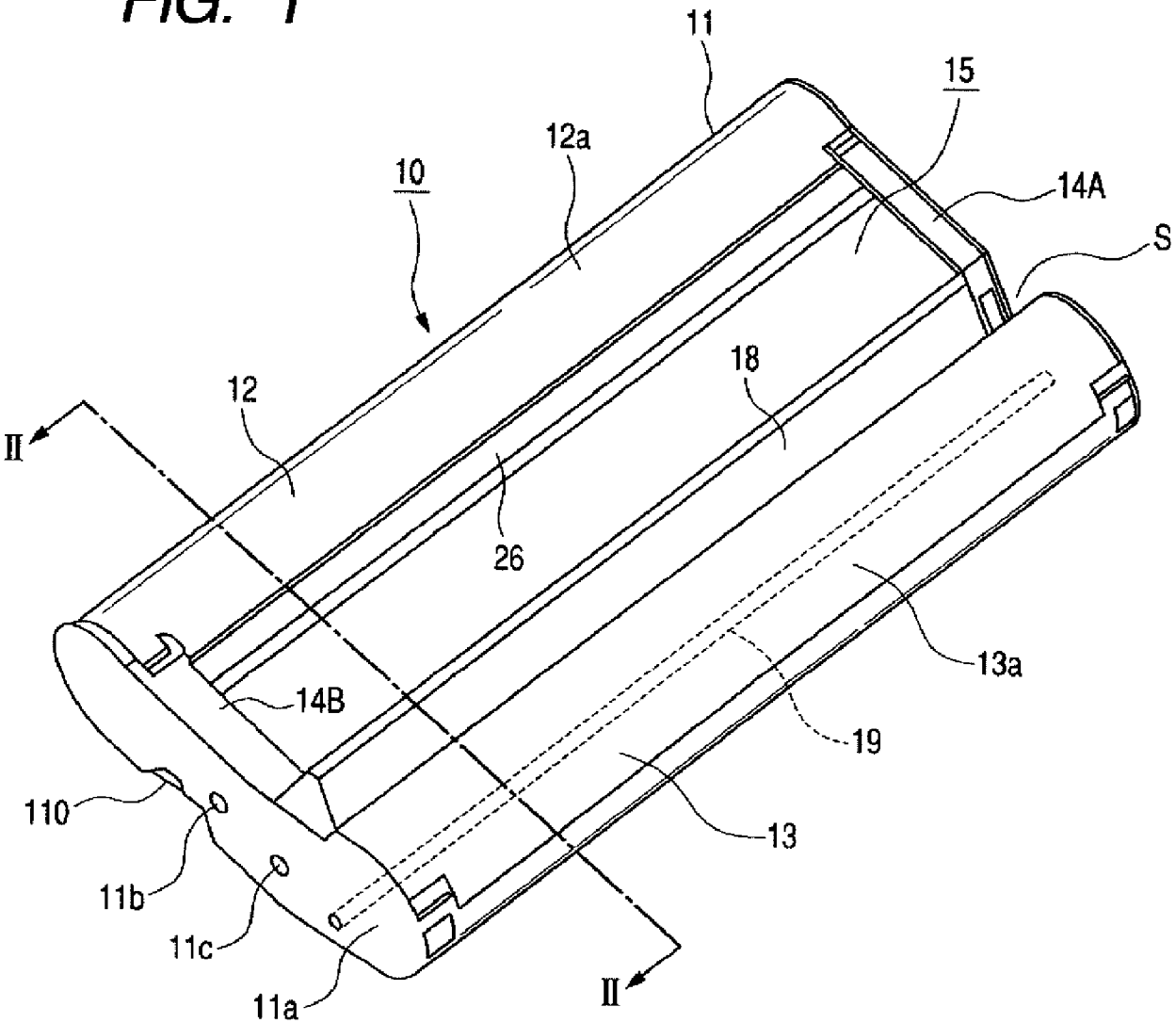
FIG. 1 is a perspective view illustrating a ribbon cassette according to an exemplary embodiment.

Ribbon Cassette:

As shown in FIG. 1, a ribbon cassette 10 according to the exemplary embodiment has a resin cassette case 11 having a substantially rectangular shape. The cassette case 11 includes a first receiving portion 12 having a cylindrical shape, and a second receiving portion 13 that is disposed away from the first receiving portion 12 by a predetermined interval and has the same cylindrical shape. A first connecting member 14A connects front end portions of the first and second receiving portions 12 and 13 inserted in a ribbon cassette mounting portion 103 of a printer 100. A second connecting member 14B connects the rear end portions of the first and second receiving portions 12 and 13 (hereinafter, the first and second connecting members are referred to as a pair of connecting members 14 as necessary). The whole sectional shape of the cassette case 11 has a substantial crank shape. In the cassette case 11, a side plate portion 11*a* connects and integrates the pair of connecting members 14 in the center thereof. An opening hollow portion 15, with a rectangular shape, is surrounded by the first receiving portion 12 and a wall portion 18. The second connecting member 14B connects the rear end portions of the first and second receiving portions 12 and 13.

Third and fourth positioning holes 11*b* and 11*c* are formed in the side plate portion 11*a* at a predetermined pitch. A third positioning pin 105*a* close to a printer 100 is fitted to the third positioning hole 11*b* and a fourth positioning pin 105*b* is fitted to the fourth positioning hole 11*c* (See FIG. 7). A space corresponding to the opening hollow portion 15 includes a first space portion 17A where a thermal head as a line head of the printer 100 is disposed (See FIGS. 2 and 3). A locking hole (locking member) 110 locking a locking claw 111 is formed in the side plate portion 11*a* so as to fix and lock the ribbon cassette 10 inserted to a ribbon cassette mounting portion 103.

Figure 2:
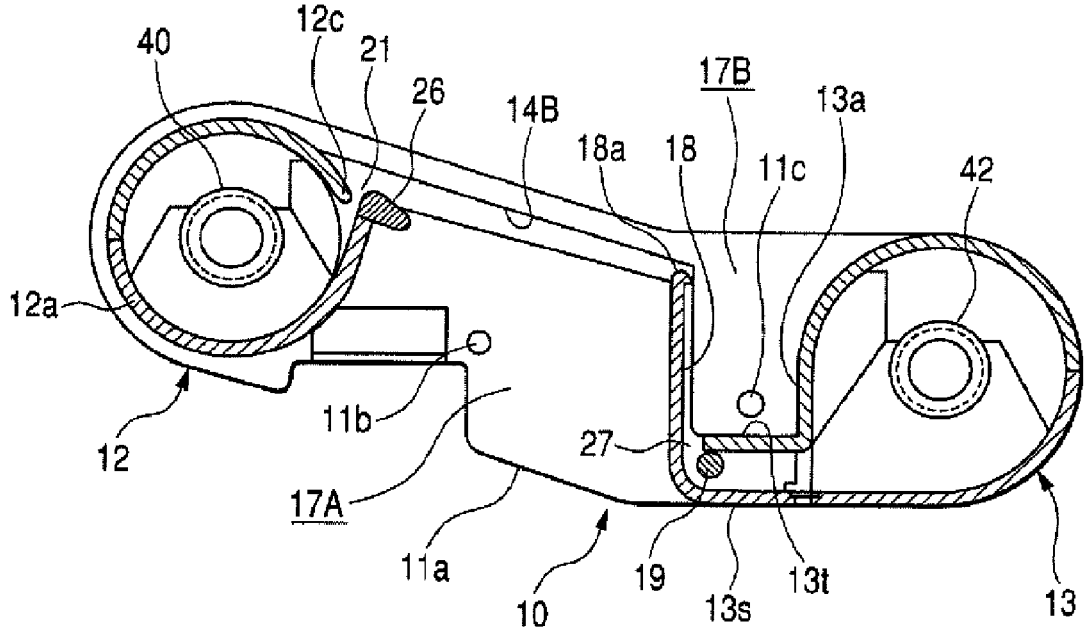
FIG. 2 is a sectional view illustrating the ribbon cassette of FIG. 1 taken along Line II-II.
Figure 3:
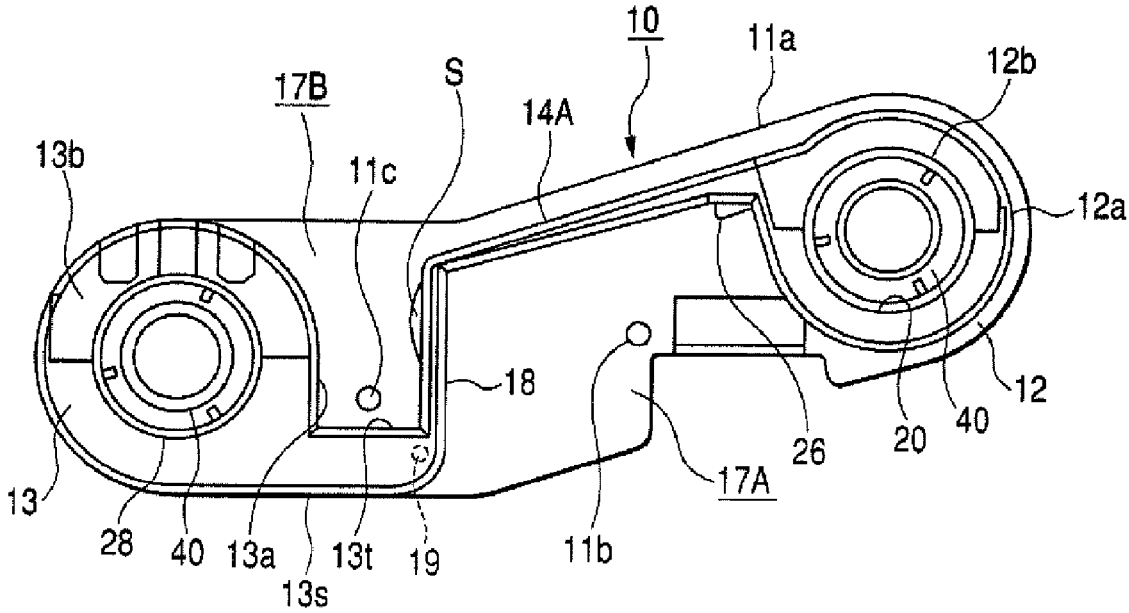
FIG. 3 is a side view illustrating a front end in an insertion direction of the ribbon cassette of FIG. 1.

As shown in FIGS. 2 and 3, in the first receiving portion 12, a flange portion 26 having a taper shape extending outwardly in some extent is provided in an edge portion having a large diameter of a peripheral wall portion 12*a* having a cylindrical shape along with the edge portion. Both ends of the flange portion 26 are integrated with a pair of connecting members 14. An edge portion 12*c* with a small diameter of the peripheral wall portion 12 is disposed so as to have an inward spiral shape opposed to an edge portion (flange portion 26) with a larger diameter of the peripheral wall portion 12*a*. A space between the flange portion 26 and the edge portion 12*c* of the peripheral wall portion 12*a* is formed as a supplying port 21 for drawing an ink ribbon R used for printing. A circular side surface portion 12*b* (See FIG. 3) opposed to the side plate portion 11*a* is disposed in the other surface of the peripheral portion 12*a* of the first receiving portion 12. A circular opening portion 20 is formed in the side surface portion 12*b*. A first positioning hole (not shown) is formed in the side surface portion 12*b*. A first positioning pin (not shown) in a printer 100 is fitted to the first positioning hole.

A plate-shaped extending portion 13*s* that extends from one edge portion of the peripheral portion 13*a* to a pair of connecting members 14 is integrally formed in the second receiving portion 13. The second receiving portion 13 is opposed to the side plate portion 11*a* and a circular side surface portion 13*b* is disposed in the other end portion of the cylindrical peripheral wall portion 13*a*. A circular opening portion 28 is formed in the side surface portion 13*b*. Furthermore, a second positioning hole (not shown) is formed in the side surface portion 13*b*. A second positioning pin (not shown) in a printer 100 is fitted to the second positioning hole.

A plate-shaped wall portion 18 that is partly bridged between the pair of connecting portions 14 is provided with the pair of connecting portions 14. The wall portion 18 is opposed to the peripheral wall portion 13*a* so that a second space portion 17B for positioning a driven-roller mounting plate 133 (See FIG. 8) disposed in an opening end side of a printing-portion paper transport unit 130 of a printer 100 is formed between the wall portion 18 and the second receiving portion 13. The wall portion 18 is bent to be perpendicular to the extending portion 13*s* and is integrally formed to extend from a frond end portion of the extending portion 13*s*. In the printing-portion paper transport unit 130 of the printer, a paper transport roller 131, a driven roller 132, and a driven-roller mounting plate are sequentially disposed. The paper transport roller 131 extends in a width direction of the ink ribbon R and is supported so as to positively and negatively rotate by a driving source not shown. Similarly, the driven roller 132 extends in the width direction of the ink ribbon R and comes in contact with the paper transport roller 131 to be rotatably supported. The driven-roller mounting plate 133 extends in the width direction of the ink ribbon R and urges the driven roller 132 to the paper transport roller 131 by an urging member such as a spring so as to rotatably support the driven roller 132 along the wall portion 18. The driven-roller mounting plate 133 disposed in the releasing end of the releasing end faces the second space portion 17B (see FIG. 8 for reference).

An edge portion (first supporting portion) 18*a* in the front end of the wall portion 18 has a circular shape. The edge portion 18*a* becomes a supporting portion when the ink ribbon R is slid so as to contact with the edge portion 18*a*. A plate-shaped extending piece 13*t* opposed to the extending portion 13*s* is integrally provide with the other edge portion as a free end of the wall portion 13*a* in the second receiving portion 13. A space between the extending portion 13*t* of the peripheral wall portion 13*a* and the wall portion 18 is formed as a winding port 27 for winding the ink ribbon R (used for printing in a winding axis 42 disposed in the second receiving portion 13).

In the ribbon cassette 10 of the embodiment, a convex portion S is formed in a connecting surface (wall-portion contact surface) of the first connecting member 14A that is opposed to the second space portion 17B of the ribbon cassette 10 and comes in contact with the wall portion 18. When the ribbon cassette 10 is mounted into the ribbon cassette mounting portion 103 of the printer 100, the top portion of the convex portion S comes in contact with the driven-roller mounting plate 133 disposed in the second space portion 17B, whereby a predetermined gap, acting as a transport passage of the ink ribbon R, is secured between the wall portion 18 and the printing-portion paper transport unit 130 (See FIG. 8).

Figure 4:
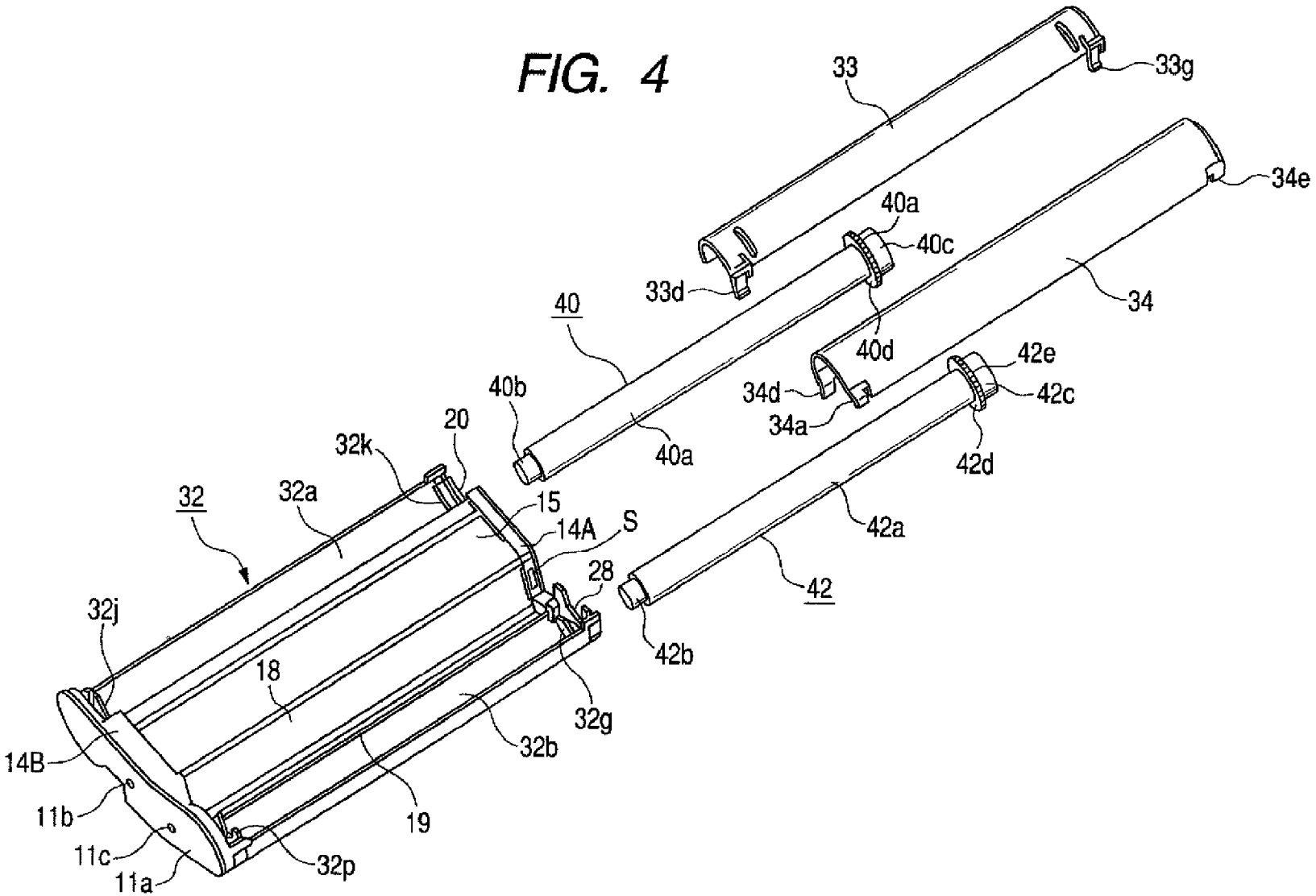
FIG. 4 is an exploded perspective view illustrating the ribbon cassette of FIG. 1 (ink ribbon is not shown).

The cassette case 11, as shown in FIG. 4, includes three parts such as a lower case 32 and two upper cases (a first upper case 33 and a second upper case 34). Accordingly, the first receiving portion 12 includes a part (first semi-cylinder portion 32*a*) of the lower case 32 and a first upper case 33 constituting a half upper portion thereof. The second receiving portion 13 includes the other portion of the lower case 32 (second semi-cylinder portion 32*b*) and a second upper case 34 constituting the half upper portion thereof. An opening hollow portion 15 is formed in the center of the lower case 32. The lower case 32 has a first semi-cylinder portion 32*a* having a semi-cylinder shape in both sides thereof, a second semi-cylinder portion 32*b* similarly having a semi-cylinder shaper a pair of connecting members 14 connecting the first and second semi-cylinder portions 32*a* and 32*b* to each other, and the side plate portion 11*a*.

In the transport passage of the ink ribbon R formed by the extending portion 13*s* integrated with the second receiving portion 13 and the extending piece 13*t*, a rotatable metal shaft 19, acting as a second supporting portion bridged between the side plate portion 11*a* and the side surface portion 12*b* (half lower portion), is attached. The ink ribbon R slidingly comes in contact with the shaft 19. Accordingly, in a shaft 19 having a small sliding resistance, the shaft 19 may not rotate. In addition, the shaft 19 coming in contact with the ink ribbon R to be slid may be omitted. The front end of the extending portion 13*s* may be made round to reduce the sliding contact resistance and then the front end portion, acting as the second supporting portion, may directly come in contact with the front end.

Figure 5:
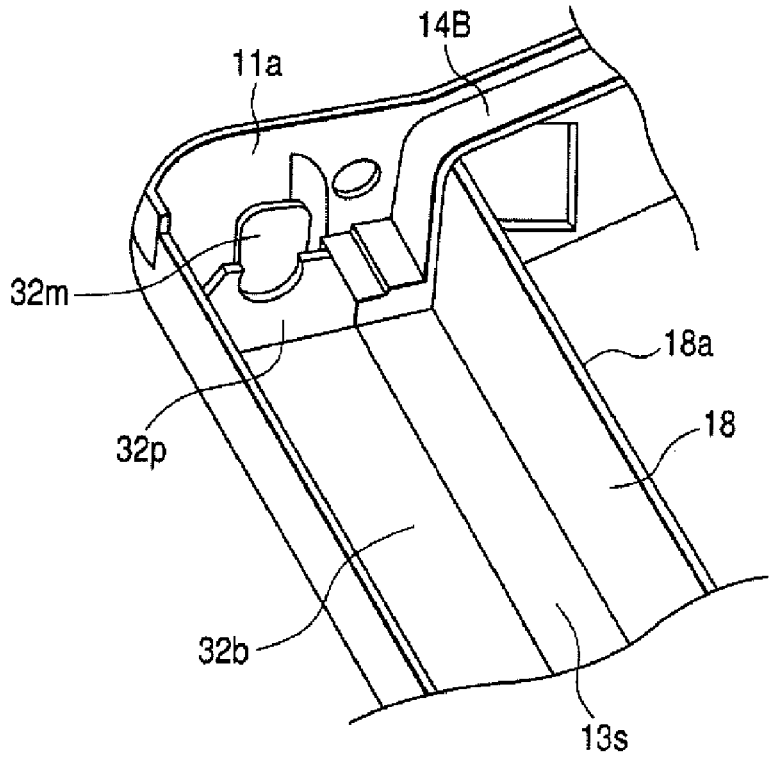
FIG. 5 is an expanded view illustrating main parts of a lower case of the ribbon cassette of FIG. 1.
Figure 6:
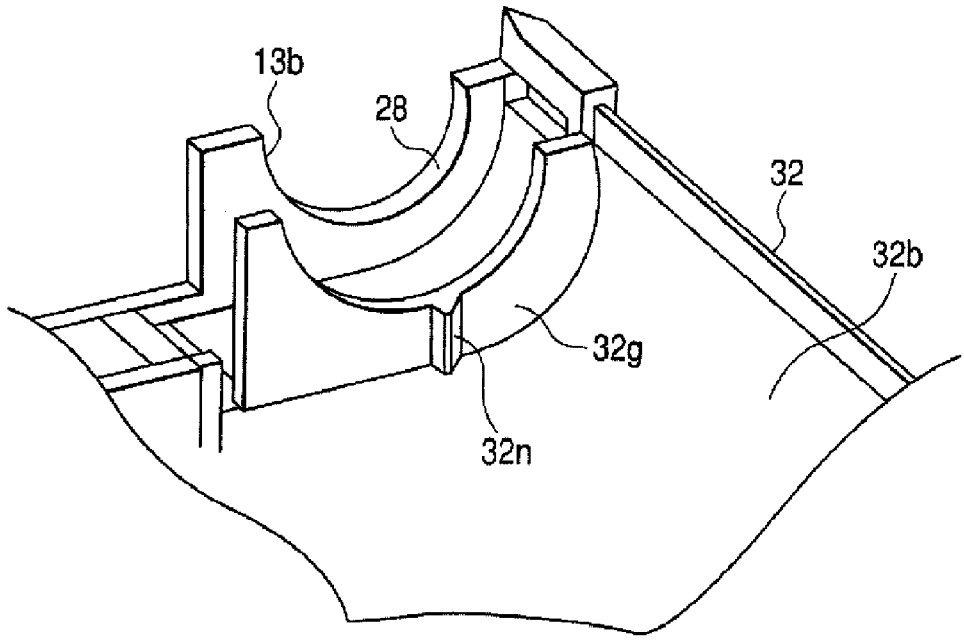
FIG. 6 is an expanded view illustrating main parts of a lower case of the ribbon cassette of FIG. 1.

In inner walls of the peripheral wall portions of the first and second semi-cylinder portions 32*a* and 32*b*, first supporting walls 32*j* and 32*p* having a U shape are provided to be opposed to the side plate portion 11*a*, respectively. An elastic mold piece 32*m* (See FIG. 5) recessed inwardly from the peripheral wall portions of the first and second semi-cylinder portions 32*a* and 32*b* is integrally formed between the first supporting walls 32*j* and 32*p* and the side plate portion 11*a* at regular intervals therebetween. In the first and second semi-cylinder portions 32*a* and 32*b*, second supporting walls 32*k* and 32*g* having U shapes in the inner walls of the peripheral wall portions are integrally provided at regular internals from the side surface portion 13*b* forming the end surface of the peripheral wall portion. In the wall surface portion of the first and second supporting walls 32*k* and 32*g*, an engaging projection 32*n* (See FIG. 6) having a triangular shape in a sectional view is formed opposed to the first supporting walls 32*j* and 32*p*. FIGS. 5 and 6 representatively show an inner configuration of the second semi-cylinder portion 32*b*.

As shown in FIG. 4, the first upper case 33 includes engaging claws 33*d* and 33*g* having an elasticity in both edges of the peripheral wall portion thereof. The second upper case 34 includes engaging claws 34*d* and 34*e* having an elasticity in both edges of the peripheral wall portion thereof.

As shown in FIG. 4, the supplying axis 40 and the winding axis 42 are made of a substantially cylindrical member having the same size and include cylinder-shaped base portions 40*a* and 42*a* provided in the center thereof, small diameter portions 40*b* and 42*b* having diameters smaller than the base portions 40*a* and 42*a* provided at one end thereof, and large diameter portions 40*c* and 42*c* having diameters larger than the base portions 40*a* and 42*a* provided at the other end thereof. Flange portions 40*d* and 42*d* having word-guard shapes are provided in boundaries between the large diameter portions 40*c* and 42*c* and the base portions 40*a* and 42*a*. A plurality of rectangular grooves 40*e* and 42*e* are formed in the outer surface portions of the flange portions 40*d* and 42*d* so as to be uniformly arranged around the axes. The ink ribbon R is wound on the base portion 40*a* of the supplying axis 40 from the front edge of the ink ribbon R to the base portion 42*a* of the winding axis 42. The engaging projections 32*n* of the second supporting wall portions 32*k* and 32*g* reliably engage with the rectangular grooves 40*e* and 42*e* of the supplying axis 40 and the winding axis 42. For example, when the ribbon cassette 10 is transferred at the non-use time, the ink ribbon R becomes loose so as not to rub on the cassette case 11.

The ribbon cassette 10 is assembled as follows. As shown in FIG. 4, firstly, the lower case 32 is arranged and then the supplying axis 40 is inserted from the upper part thereof into the first semi-cylinder portion 32*a* of the lower case 32. Then, the front end of the small diameter portion 40*b* of the deliver axis 40 is allowed to elastically come in contact with the mold piece 32*m*. The small diameter portion 40*b* of the winding axis 40 is allowed to come in contact with the first supporting wall 32*j* of the lower case 32. Then, the large diameter portion 40*c* of the supplying axis 40 comes into contact with the second supporting wall 32*k* and the inside of the opening portion 20 of the side surface portion 13*b*.

The front end of the ink ribbon R wound on the supplying axis 40 extends to the second semi-cylinder portion 32*b* so that the first upper case 33 overlaps with the lower case 32 receiving the supplying axis 40. Then, the engaging claws 33*d* and 33*g* are fitted to hole portions (not shown) of the lower case 32 to be attached and fixed.

Next, the winding axis 42 is arranged. That is, in order to draw the ink ribbon R and wind it to the winding axis 42, the mold piece 32*m* is pressed by the supplying axis 40 in the direction of the rotating axis, the engaging projection 32*n* of the lower case 32 is released from the rectangular groove 40*e* of the winding axis 40, and then the ink ribbon R is further allowed to extend to the winding axis 42. The ink ribbon R drawn from the supplying port 21 passes by the edge portion 18*a* in the front end of the wall portion 18 as the first supporting portion. The front end thereof is wound on the shaft 19 so as to be slid in contact with the shaft 19. The front end is adhered to the winding axis 42 by an adhesive not shown and is wound several times to be fixed.

In the second semi-cylinder portion 32*b* of the lower case 32, the front end of the small diameter portion 42*b* of the winding axis 42 elastically comes in contact with the mold piece 32*m*. The small diameter portion 42*b* of the winding axis 42 comes in contact with the first supporting wall 32*p*, and the large diameter portion 42*c* of the winding axis 42 comes in contact with the second supporting wall 32*g* and the inside of the opening portion 28 of the side surface portion 13*b*. Then, the second upper case 34 is reliably attached and fixed by the engaging claws 34*d* and 34*e* to the lower case 32 in which the supplying axis 40, the first upper case 33, and the winding axis 42 are mounted in advance to be integrated.

In the ribbon cassette 10 assembled above, the ink ribbon R is drawn from the supplying port 21 of the supplying axis 40 in the projecting direction of the taper-shaped flange portion 26 so as to be exposed in the opening hollow portion 15 as the first space portion where the thermal head is located. Then, the ink ribbon R is slid in contact with the edge portion 18*a* in the front end formed in the wall portion 18 as the second supporting portion so as to be bent. The ink ribbon R is transported along the wall portion 18 of the cassette case 11 and is slid in contact with the shaft 19, acting as the second supporting portion, in the winding port 27 so as to be bent by about 90°. That is, the ink ribbon is withdrawn into the second receiving portion 13 by the edge portion 18*a* of the wall portion 18, acting as the first supporting portion, and the shaft 19, acting as the second supporting portion, through the transport passage formed in a crank shape so as to be wound on the winding axis 42. In this case, the ink ribbon R supplied for printing is slid in contact with the shaft 19, thereby applying a regular tension.

Next, the printer 100 is described in which the ribbon cassette 10 of the embodiment is mounted.

Figure 7:
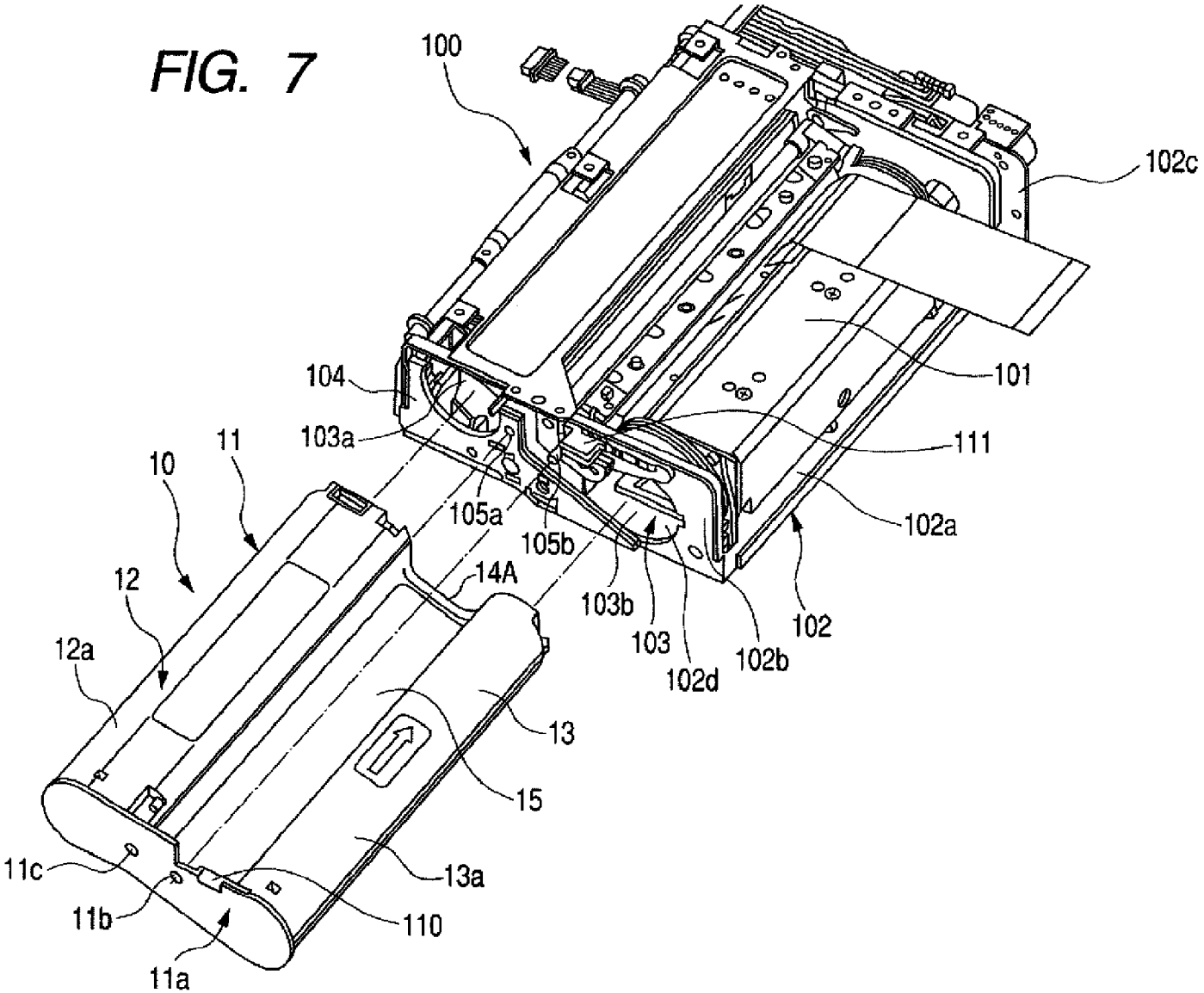
FIG. 7 is a perspective view illustrating an operation of the ribbon cassette mounted in a printer according to an exemplary embodiment.

The printer 100 in which the ribbon cassette 10 is mounted may be equal to configurations of the known printer. In the printer 100, as shown in FIG. 7, a chassis 102 formed of a metal plate is disposed and the chassis 102 has a substantial U shape including a bottom plate 102*a* and including a front side plate 102*b* and a rear side plate 102*c* facing each other. A head mount 101 to which a thermal head is attached in the lower portion thereof is disposed in the chassis 102. The thermal head is formed of a line head in which a head is capable of moving up and down from a platen (not shown) disposed in the printing portion.

A printing-portion paper transport unit 130 (See FIGS. 8, 9, and 10) that supplies and discharges paper to the printing portion is disposed in the vicinity of the printing portion. A paper transport roller 131, a driven roller 132, and a driven-roller mounting plate 133 are sequentially disposed in the printing-portion paper transport unit 130. The paper transport roller 131 extends in a width direction of the ink ribbon R received in the ribbon cassette 10 (mounted in the printer 100) and is supported so as to positively and negatively rotate by a driven source not shown. The driven roller 132 extends in the width direction of the ink ribbon R and is supported so as to dependently rotate in contact with the paper transport roller 131. The driven-roller mounting plate 133 extends in the width direction of the ink ribbon R and detachably supports the driven roller 132 to paper transport roller 131.

A substantially glasses-shaped insertion port 102*d* to which the ribbon cassette 10 is inserted from the front end portion thereof is formed in the front side plate 102*b*. A hollow-shaped cassette mounting portion 103, which the ribbon cassette 10 is mounted in, is formed on the bottom plate 102*a* between the front side plate 102*b* and the rear side plate

102*c*. A supplying bobbin and a winding bobbin (all not shown) that are respectively fitted to the supplying axis 40 and the winding axis 42 received in the ribbon cassette 10 are rotatably disposed. First and second positioning pins (all not shown) for positioning the front end of the ribbon cassette 10 are disposed in the inner surface of the rear side plate 102*c* at predetermined pitches. The ribbon cassette 10 is mounted in the cassette mounting portion 103 so that the first receiving portion 12 that receives the supplying axis 40 is located in the first hollow portion 103*a* of the cassette mounting portion 103. The second receiving portion 13 that receives the supplying axis 32 is located in the second hollow portion 103*b*. The cassette mounting portion 103 is configured so that the engagement between the engaging projections 32*n* and the rectangular grooves 40*e*, 42*e* is released in the first and second receiving portions 12, 13. The supplying axis 40 and the winding axis 42 can rotate by a rotary driving device not shown when the printer 100 is driven to operate.

A cassette guide 104 made of a resin material is attached to the front surface of the front side plate 102*b* of the chassis 102. The cassette guide 104 prevents the ribbon cassette 10 inserted to the cassette mounting portion 103 from being damaged due to friction with the insertion port 102*d*. A locking claw (locking member) for fixing and locking the ribbon cassette 10 inserted to the ribbon cassette mounting portion 103 is disposed in the front side plate 102*b*. A third positioning pin 105*a* is disposed in a position that is on the cassette guide 104 on the front surface of the front side plate 102*b* and corresponds to the side of the printing-portion paper transport unit 130. A fourth positioning pin 105*b* is disposed in the front side plate 102*b* adjacent to the first hollow portion 103.

A cassette detecting means (not shown) for detecting the ribbon cassette 10 mounted in the cassette mounting portion 103 is disposed in the cassette mounting portion 103 of the printer 100. The cassette detecting means has a switch (not shown). The side surface portions 12*b*, 13*b* of the cassette case 11 of the ribbon cassette 10 (mounted in the cassette mounting portion 103) press the switch. The ribbon cassette 10 inserted to the cassette mounting portion 103 presses the switch, whereby it can be detected that the ribbon cassette 10 is mounted in the cassette mounting portion 103.

When the ribbon cassette 10 of the embodiment is mounted in the printer 100 configured above, the ribbon cassette 10 is inserted from the insertion portion 102*d* to the cassette mounting portion 103. In the ribbon cassette 10, the first receiving portion 12 receiving the supplying axis 40 is located in the first hollow portion 103*a*. The second receiving portion 13 receiving the winding axis 42 is located in the second hollow portion 103*b*. The printing-portion paper transport unit 130 is inserted into the second space portion 17B so as to faces the opening end thereof (See FIG. 8). In the embodiment, the convex portion S of the ribbon cassette 10 is slid in contact with the driven-roller mounting plate 133, whereby the ribbon cassette 10 can be easily guided to the proper mounting position. In the front end portion of the ribbon cassette 10 in a insertion direction thereof, a supplying core, acting as an ink ribbon transport device in the printer 100, is fitted into a large diameter portion 40*c* of the supplying axis 40 disposed in the opening portion 20 formed in the first receiving portion 12. A winding core, acting as an ink ribbon transport device in the printer 100, is fitted into the large diameter portion 42*c* of the winding axis 42 disposed in the opening portion 28 formed in the second receiving portion 13. In the rear end portion of the ribbon cassette 10 in a insertion direction thereof, while the third positioning pin 105*a* of the printer 100 is fitted into the first positioning hole 11*b* of the side plate portion 11*a* and the fourth positioning pin 105*b* of the printer 100 is fitted into the second positioning hole 11*c*, the side plate portion 11*a* can be fixed in contact with the front side plate 102*a* of the printer 100 by the locking means 110, 111.

Figure 8:
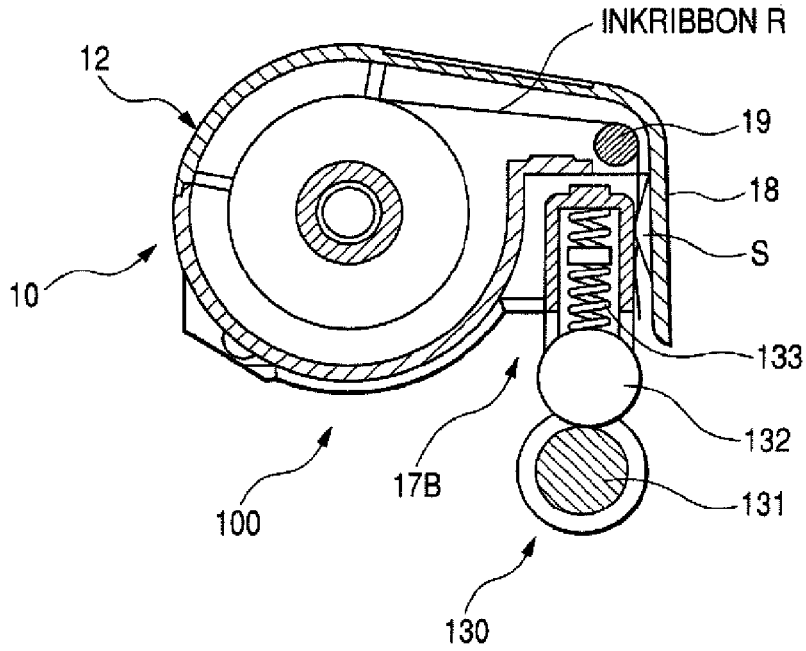
FIG. 8 is a sectional view illustrating a locative relation between a ribbon cassette (second space portion) and a printing-portion paper transport unit (driven-roller mounting plate) of a printer when the ribbon cassette of FIG. 1 is mounted in the printer.

In the ribbon cassette 10 fixed to the printer 100, as shown in FIG. 8, the top portion of the convex portion S formed on the wall-portion contact surface of the first connecting member 14A opposed to the second space portion 17B comes in contact with the driven-roller mounting plate 133 disposed in the second space portion 17B, whereby the gap, acting as the transport passage of the ink ribbon R, can be secured between the wall portion 18 and the printing-portion paper transport unit 130.

When the ribbon cassette 10 is properly mounted in the cassette mounting portion 103, the switch, acting as the cassette detecting means, is pressed by the side surface portions 12*b*, 13*b* of the cassette case 11, thereby detecting that the ribbon cassette 10 corresponding to the printer 100 is mounted in the cassette mounting portion 103.

Herein, the printing operation in the case where the ribbon cassette 10 is mounted in this printer 100 is described.

When the ribbon cassette 10 having the ink ribbon R with a desired color is mounted in the ribbon cassette mounting portion 103 and printing information is selected from a plurality of printing information, the printer 100 transports the printing paper by a supplying device (not shown) and then interposes between the paper transport roller 131 of the printing-portion paper transport unit 130 and the driven roller 132 pressed in contact with the paper transport roller 131. Then, the paper transport roller 131 is driven to rotate in a positive direction, whereby the printing paper is transported between the platen and the thermal head separated from each other. Tn a state that a printing starting position of the printing paper is matched to a position where the heat-emitting element of the thermal head is disposed, rotation of the paper transport roller 131 and the driven roller 132 stops, and then the thermal head moves close to the platen so as to become in a head down state. The ink ribbon R facing the opening hollow portion 15 and the printing paper are pressed in contact with each other with the ink ribbon R and the printing paper overlapping each other. The heat-emitting element of the thermal head selectively emits heat on the basis of desired printing information and then ink of the ink ribbon R is transferred with heat, thereby performing a desired printing operation. After the printing operation, the platen returns in the original position separated from the thermal head. The paper transport roller 131 is driven to rotate in the negative direction, whereby the printing paper is negatively transported while the printing paper comes in elastic contact with the rotating driven roller 132 so as to be discharged from the printing portion outwardly.

In the ribbon cassette 10 of the embodiment, as described above, the ink ribbon R used for printing is drawn from the supplying port 21 of the supplying axis 40 in the projecting direction of the flange portion 26 and is exposed to the opening hollow portion 15 of the first space portion 17A where the thermal head is located. Then, the ink ribbon R is slid in contact with the edge portion 18*a* in the front end formed in the wall portion 18, acting as the first supporting portion, so as to be bent. The ink ribbon R is transported along the wall portion 18 of the cassette case 11 and is slid in contact with the shaft 19, acting as the second supporting portion, in the winding port 27 to be bent by about 90°. That is, the ink ribbon R is withdrawn into the second receiving portion 13 by the edge portion 18*a* of the wall portion 18, acting as the first supporting portion, and the shaft 19, acting as the second supporting portion, through the transport passage formed in a crank shape so as to be wound on the winding axis 42. In this case, the ink ribbon R supplied for printing is transported by the edge portion 18*a* of the wall portion 18 and the shaft 19 to the transport passage having the crank-shaped traveling passage so as to slide in contact with the shaft 19, whereby a regular tension is applied to the ink ribbon R. Accordingly, occurrences of the looseness of the ink ribbon R are suppressed. Because the ink ribbon R is wound and transported without the looseness, the ink ribbon R is prevented from being wound or drawn to the printing-portion paper transport unit 130 of the printer 100, thereby satisfactorily winding and transporting the ink ribbon R.

In the ribbon cassette of the embodiment, as described above, the top portion of the convex portion S provided on the wall-portion contact surface of the first connecting member 14A opposed to the second space portion 17B comes in contact with the driven-roller mounting plate 133 disposed in the second space portion 17B. Therefore, the gap having the projecting degree between the wall portion 18 and the printing-portion paper transport unit 130 is secured. Accordingly, even when the ribbon cassette 10 totters or vibrates due to the winding operation of the ink ribbon R, the charged ink ribbon R is prevented from being wound or drawn to the printing-portion paper transport unit 130 of the printer 100.

Printer:

An exemplary embodiment of the printer is described. In reference numerals of the members described below, the same reference numerals are used for the common parts of the ribbon cassette 10 and the printer 100 in which the ribbon cassette 10 is mounted.

The printer 100 according to invention is to mount the ribbon cassette 10 described in the conventional example. The conventional ribbon cassette 10 is a ribbon cassette 10 in which the convex portion S is not formed on the wall-portion contact surface of the second connecting member 14B opposed to the second space portion 17B in the above-described ribbon cassette 10.

That is, this ribbon cassette 10 has a cassette case including a first receiving portion 12, a second receiving portion 13 disposed at a predetermined internal with the first receiving portion 12, a first connecting member 14A connecting the front ends of the first and second receiving portions 12 and 13 inserted into a ribbon cassette mounting portion 103 of the printer 100, and a second connecting member 14B connecting the rear ends of the first and second receiving portions 12 and 13. The ribbon cassette 10 has a supplying axis 40 and a winding axis 42 that are respectively received in the first and second receiving portions 12 and 13 so as to rotate. A wide ink ribbon R is disposed on the supplying axis 40 and the winding axis 42 and is drawn from the supplying axis 40 and then is wound on the winding axis 42. A first supporting portion formed of a wall portion 18 bridged between the pair of connecting members 14 is provided. A second supporting portion 19 along the width direction of the ink ribbon R is provided in the second receiving portion 13 receiving the winding axis 42 so as to correspond to the first supporting portion. The ink ribbon R drawn from the supplying axis 40 and supplied for printing is bent at the first supporting portion 18*a*. The ink ribbon R is subsequently bent at the second supporting portion 18 to be transported and is wound on the winding axis 42.

Figure 9:
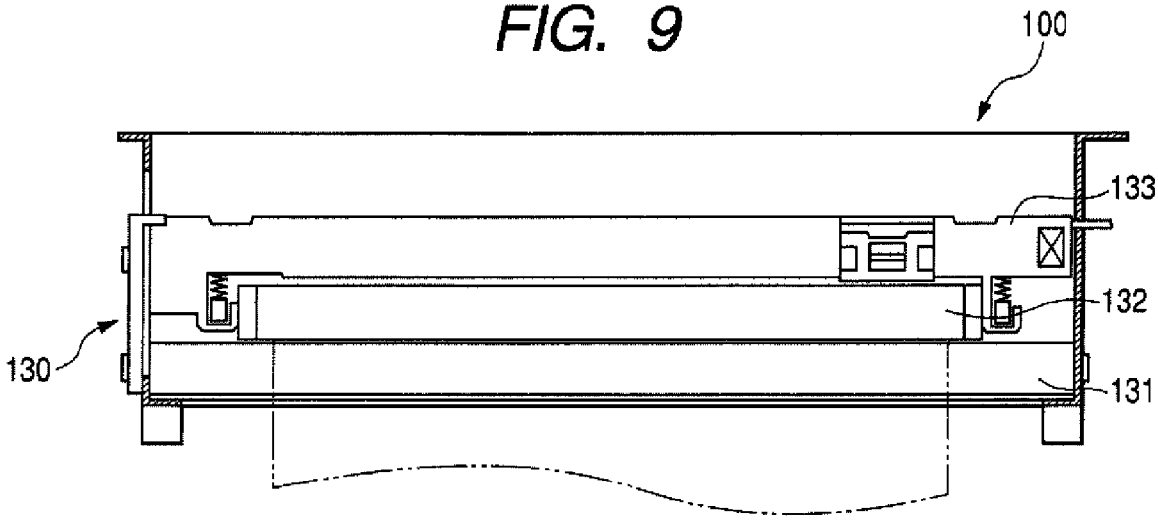
FIG. 9 is a schematic diagram illustrating a printing-portion paper transport unit as a main part of the printer as viewed from a second space portion side according to an exemplary embodiment.

In the printer 100 according to the exemplary embodiment, the configuration of the printer 100 in the embodiment with respect to the described ink ribbon of the embodiment means that the configuration of the printing-portion paper transport unit 130 is made different. In the printer 100, as shown in FIGS. 8 and 9, a convex portion S is formed on a surface of the driven-roller mounting plate 133 opposed to the second space portion 17B and opposed to the first connecting member 14A of the ribbon cassette 10. The top portion of the convex portion S comes in contact with the first connecting member 14A, whereby a gap, acting as the transport passage of the ink ribbon R, is secured between the wall portion 18 and the printing-portion paper transport unit 130.

Figure 10:
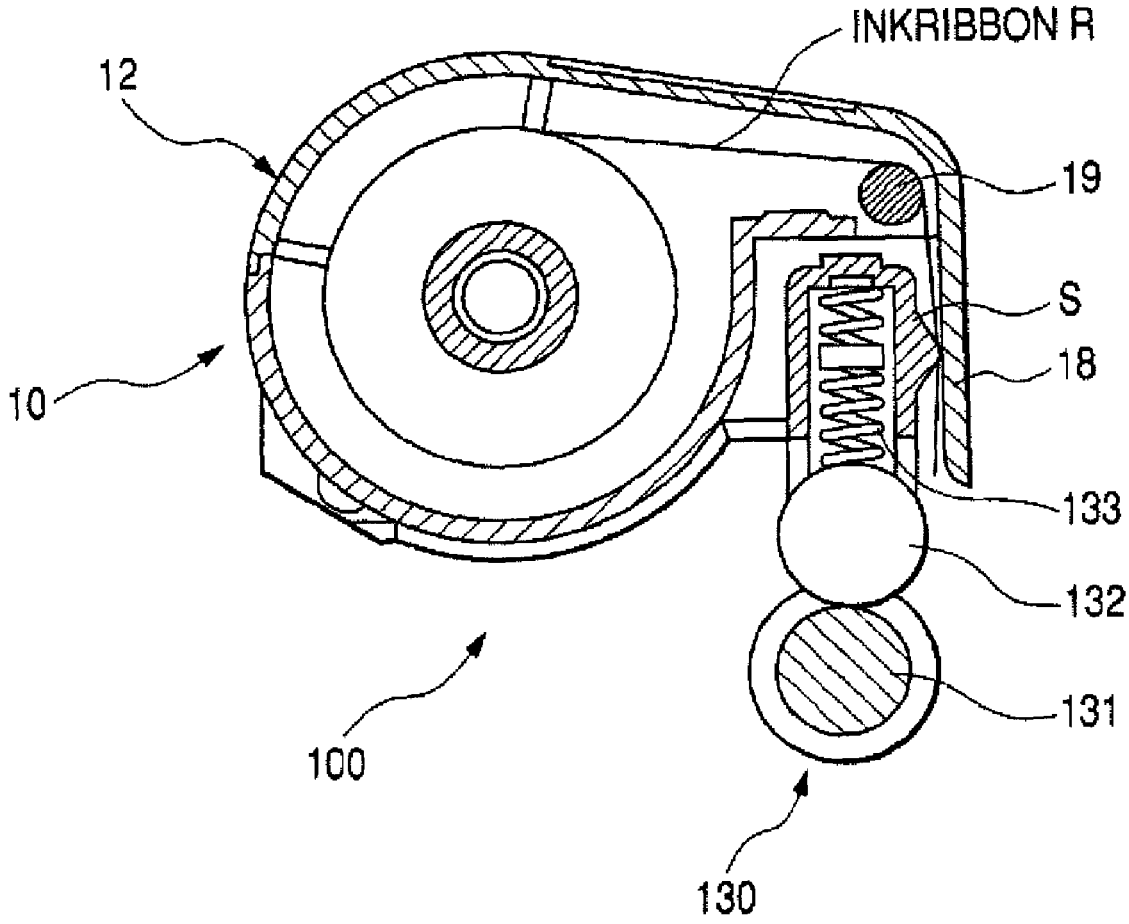
FIG. 10 is a sectional view illustrating a locative relation between a printing-portion paper transport unit (driven-roller mounting plate) of a printer and a ribbon cassette (second space portion) when the ribbon cassette is mounted in the printer of an exemplary embodiment.

In the printer configured above, as shown in FIG. 10, the top portion of the convex portion S formed on the driven-roller mounting plate 133 comes in contact with the first connecting member 14A of the ribbon cassette 10, thereby securing the gap as the transport passage of the ink ribbon R between the wall portion 18 and the printing-portion paper transport unit 130. Accordingly, even when the ribbon cassette 10 totters and vibrates due to the winding operation of the ink ribbon R, the charged ink ribbon R is prevented from being wound or drawn to the printing-portion paper transport unit 130 of the printer 100. That is because the gap is formed between the ink ribbon R drawn from the supplying axis 40, bent at the first supporting portion 18*a*, and transported to the second supporting portion 19 and the printing-portion paper transport unit 130. Therefore, the ink ribbon R can be satisfactorily wound and transported.

The invention has been made to solve the above-mentioned problems, and an object of the invention is to provide a ribbon cassette and a printer having means for preventing the ink ribbon from being wound or drawn to the printing-portion paper transport unit of the printer, specifically, the paper transport roller or the driven roller.

In the ribbon cassette, the top portion of the convex portion provided on the wall-portion contact surface of the first connecting member opposed to the space portion comes in contact with the driven-roller mounting plate disposed in the space portion when the ribbon cassette is mounted in the printer, thereby securing a predetermined gap between the wall portion and the printing-portion paper transport unit. Accordingly, even when the ribbon cassette totters or vibrates due to the winding operation of the ink ribbon, the charged ink ribbon R is prevented from being wound or drawn to the printing-portion paper transport unit of the printer. That is because the gap is formed between the ink ribbon supplied from the winding axis, bent at the first supporting portion, and transported to the second supporting portion and the printing-portion paper transport unit.

When the ribbon cassette is inserted into the printer, the convex portion is slid in contact with the driven-roller mounting plate, thereby guiding the ribbon cassette to a proper mounting position.

In the ribbon cassette, the second supporting portion is formed of a shaft bridged between the side plate portion of the cassette case and the side surface portion of the second receiving portion, thereby applying tension to the ink ribbon slid in contact with the shaft. Accordingly, loosening of the ink ribbon is suppressed. The extending ink ribbon without looseness is wound and transported, whereby the ink ribbon is further reliably prevented from being wound or drawn to the printing-portion paper transport unit of the printer. Therefore, the ink ribbon can be satisfactorily wound and transported.

In the printer, when the ribbon cassette is mounted, the top portion of the convex portion formed on the surface opposed to the second connecting member of the ribbon cassette in the second side wall portion of the driven roller mounting plate comes in contact with the first connecting member of the ribbon cassette, thereby securing a gap, acting as the transport passage of the ink ribbon, between the wall portion and the printing-portion paper transport unit. Accordingly, even when the ribbon cassette totters or vibrates due to the winding operation of the ink ribbon, the charged ink ribbon R is prevented from being wound or drawn to the printing-portion paper transport unit of the printer. This is so because the gap is formed between the ink ribbon supplied from the winding axis, bent at the first supporting portion, and transported to the second supporting portion and the printing-portion paper transport unit. Therefore, the ink ribbon can be satisfactorily wound and transported.

The invention is not limited to the above-described embodiment, but may be variously modified as necessary. It is intended that the foregoing detailed description be regarded as illustrative rather than limiting, and that it be understood that the following claims, including all equivalents, are intended to define the scope of this invention.

What is claimed is:

1. A ribbon cassette comprising:

a cassette case that has a first receiving portion;

a second receiving portion disposed at a predetermined interval from the first receiving portion and operable to be inserted into a ribbon cassette mounting portion of a printer together with the first receiving portion;

a first connecting member operable to connect the front ends of the first and second receiving portions in an insertion direction of the first and second receiving portions into the ribbon cassette mounting portion;

a second connecting member operable to connect the rear ends of the first and second receiving portions in the insertion direction of the first and second receiving portions; and an ink ribbon that is disposed in a supplying axis and a winding axis rotatably received in the first and second receiving portions and is operable to be drawn from the supplying axis and wound on the winding axis, wherein a first supporting portion formed of a wall portion that is bridged between the first and second connecting members is provided, a second supporting portion is provided in the second receiving portion receiving the winding axis so as to correspond to the first supporting portion in a width direction of the ink ribbon, and the ink ribbon drawn from the supplying axis and supplied for printing is configured to be bent at the first supporting portion, subsequently bent at the second supporting portion, and wound on the winding axis, wherein a space portion is provided between the wall portion and the second receiving portion such that the space portion faces a part of a printing-portion paper transport unit in which a paper transport roller, which extends in the width direction of the ink ribbon of the printer, is supported so as to rotate, a driven roller, which extends in the width direction of the ink ribbon, is supported so as to rotate in contact with the paper transport roller, and a driven-roller mounting plate, which extends in the width direction of the ink ribbon, is supported so as to get close to and apart from the paper transport roller, and the paper transport roller, the driven roller, and the driven-roller mounting plate are sequentially disposed along the wall portion, and wherein a convex portion is provided on a wall-portion contact surface of the first connecting portion opposed to the space member so that a top portion of the convex portion comes in contact with the driven-roller mounting plate disposed in the space portion when the ribbon cassette is mounted in the ribbon cassette mounting portion of the printer.

2. The ribbon cassette according to claim 1, wherein the second supporting portion is bridged between a side plate portion of the cassette case and a side surface portion of the second receiving portion and includes a shaft rotating about an axis.

3. A printer in which a ribbon cassette is inserted into an insertion port formed in a wall portion of a chassis and is mounted into a cassette mounting portion in the chassis, the ribbon cassette comprising:

a cassette case that has a first receiving portion;

a second receiving portion disposed at a predetermined interval from the first receiving portion and is operable to be inserted into a ribbon cassette mounting portion of a printer together with the first receiving portion;

a first connecting member operable to connect the front ends of the first and second receiving portions in an insertion direction of the first and second receiving portions into the ribbon cassette mounting portion;

a second connecting member operable to connect the rear ends of the first and second receiving portions in the insertion direction of the first and second receiving portions; and an ink ribbon that is disposed in a supplying axis and a winding axis rotatably received in the first and second receiving portions and is operable to be drawn from the supplying axis and wound on the winding axis, wherein a first supporting portion formed of a wall portion that is bridged between the first and second connecting members is provided, a second supporting portion is provided in the second receiving portion receiving the winding axis so as to correspond to the first supporting portion in a width direction of the ink ribbon, and the ink ribbon drawn from the supplying axis and supplied for printing is configured to be bent at the first supporting portion, subsequently bent at the second supporting portion, and wound to the winding axis, wherein a space portion is provided between the wall portion and the second receiving portion such that the space portion faces a part of a printing-portion paper transport unit in which a paper transport roller, which extends in the width direction of the ink ribbon of the printer, is supported so as to rotate, a driven roller, which extends in the width direction of the ink ribbon, is supported so as to rotate in contact with the paper transport roller, and a driven-roller mounting plate, which extends in the width direction of the ink ribbon, is supported so as to get close to and apart from the paper transport roller, and the paper transport roller, the driven roller, and the driven-roller mounting plate are sequentially disposed along the wall portion, and wherein a convex portion opposed to the space portion of the driven-roller mounting plate is provided in a surface opposed to the second connecting member of the ribbon cassette so that a top portion of the convex portion comes in contact with the first connecting member of the ribbon cassette.

* * * * *